US007815347B2

(12) United States Patent
Lin et al.

(10) Patent No.: US 7,815,347 B2
(45) Date of Patent: Oct. 19, 2010

(54) LED LAMP TUBE HEAT DISSIPATING STRUCTURE

(75) Inventors: Kuo-Len Lin, Wugu Township, Taipei County (TW); Chen-Hsiang Lin, Wugu Township, Taipei County (TW); Wen-Jung Liu, Wugu Township, Taipei County (TW); Hwai-Ming Wang, Wugu Township, Taipei County (TW); Ken Hsu, Wugu Township, Taipei County (TW); Chih-Hung Cheng, Wugu Township, Taipei County (TW)

(73) Assignees: CPUMate Inc., Taipei (TW); Golden Sun News Techniques Co., Ltd., Taipei (TW)

( * ) Notice: Subject to any disclaimer, the term of this patent is extended or adjusted under 35 U.S.C. 154(b) by 238 days.

(21) Appl. No.: 12/166,591

(22) Filed: Jul. 2, 2008

(65) Prior Publication Data

US 2010/0002439 A1 Jan. 7, 2010

(51) Int. Cl.
*F21V 29/02* (2006.01)

(52) U.S. Cl. ..... 362/373; 362/294; 362/218

(58) Field of Classification Search ..... 362/373, 362/294, 218, 547, 345, 264, 126, 580, 240, 362/249.02–249.04, 800
See application file for complete search history.

(56) References Cited

U.S. PATENT DOCUMENTS 5,655,830 A * 8/1997 Ruskouski ..... 362/240
2009/0185379 A1* 7/2009 Chen ..... 362/294

* cited by examiner

*Primary Examiner*—Bao Q Truong
(74) *Attorney, Agent, or Firm*—Chun-Ming Shih; HDLS IPR Services

(57) ABSTRACT

A light emitting diode (LED) lamp tube heat dissipating structure is capable of dissipating heat in a tube quickly to improve the heat dissipating efficiency. A circuit board with a light radiating surface and a heat dissipating surface is contained in the tube, and the light radiating surface of the circuit board is electrically connected to LED lamps. Two conductive bushings are sheathed onto both ends of the tube and electrically connected with the circuit board, and at least one heat dissipating hole is disposed separately on both distal surfaces of the tube that covers the heat dissipating surface of the circuit board, such that external air is entered into the tube from the heat dissipating hole on a distal surface of the tube and dispersed from the heat dissipating hole on another distal surface of the tube for dissipating the heat in the tube.

4 Claims, 4 Drawing Sheets

LED LAMP TUBE HEAT DISSIPATING STRUCTURE

BACKGROUND OF THE INVENTION

1. Field of the Invention

The present invention generally relates to a light emitting diode (LED) lamp tube, and more particularly to an LED lamp tube having heat dissipating holes.

2. Description of Prior Art

As light emitting diode (LED) comes with the features of low power consumption, power saving, long life, small size and quick response, LED lamps gradually substitute traditional light bulbs and become extensively used in various light emitting devices.

With reference to FIG. 1 for the structure of an LED applied in a general lamp tube, a light transmitting tube 10*a* includes a circuit board 20*a*, and the circuit board 20*a* includes a plurality of LED lamps 30*a* installed thereon, and a conductive bushing 40*a* is sheathed separately onto both ends of the light transmitting tube 10*a*, and the conductive bushing 40*a* includes an electric conducting terminal 401*a*, and the LED lamp tube is mounted onto a lamp holder by the electric conducting terminals 401*a* on both sides for electrically conducting a power source to the LED lamp 30*a* and emitting light. Since the heat produced by the LED lamp 30*a* is accumulated in the light transmitting tube 10*a*, the temperature inside the tube will becomes too high, and the high temperature will adversely affect the light emitting efficiency of the LED or even shorten the life of the LED, therefore the conventional LED lamp tube usually comes with a heat dissipating hole 101*a* disposed separately on distal surfaces of the two conductive bushings 40*a* for dissipating the heat in the light transmitting tube 10*a* through the heat dissipating hole 101*a* on the lateral sides of the conductive bushing 40*a*. In the foregoing structure with the heat dissipating holes 101*a* disposed on the lateral sides of the conductive bushing 40*a*, the direction of the rising heated air must be changed before the heat can be dissipated from the heat dissipating holes 101*a* on the lateral sides, and such arrangement is not advantageous for dissipating the hot air from the light transmitting tube 10*a* to the outside quickly. As a result, the heat dissipating efficiency is poor; a large quantity of heat produced by the LED lamp cannot be dissipated effectively and timely; the life of the LED lamp is shortened; and the maintenance and application costs are increased. Obviously, the prior art cannot meet actual requirements.

In view of the shortcomings of the prior art, the inventor of the present invention based on years of experience in the related industry to conduct extensive researches and experiments, and finally developed an LED lamp tube heat dissipating structure in accordance with the present invention.

SUMMARY OF THE INVENTION

It is a primary objective of the invention to overcome the shortcomings of the prior art by providing an LED lamp tube heat dissipating structure for discharging hot air in a tube to improve the heat dissipating efficiency, so as to maintain the light emitting efficiency of LED lamps, extend the life of LED, reduce maintenance and application costs and enhance practicability and convenience.

To achieve the foregoing objective, the present invention provides an LED lamp tube heat dissipating structure comprising: a circuit board disposed in a tube and having a light radiating surface and a heat dissipating surface; a plurality of LED lamps disposed on the light radiating surface and electrically coupled to the circuit board; two conductive bushings sheathed respectively on both ends of the tube and electrically coupled to the circuit board; and at least one heat dissipating hole disposed separately on both distal surfaces of the tube that is covered onto the heat dissipating surface of the circuit board, such that external air is entered into the tube from the heat dissipating holes on a distal surface of the tube and dispersed from the heat dissipating holes on another distal surface of the tube for dissipating the heat in the tube.

DETAILED DESCRIPTION OF THE INVENTION

The technical characteristics, features and advantages of the present invention will become apparent in the following detailed description of preferred embodiments with reference to the accompanied drawings, and the preferred embodiments are used for illustrating the present invention only, but not intended to limit the scope of the present invention.

Figure 1:
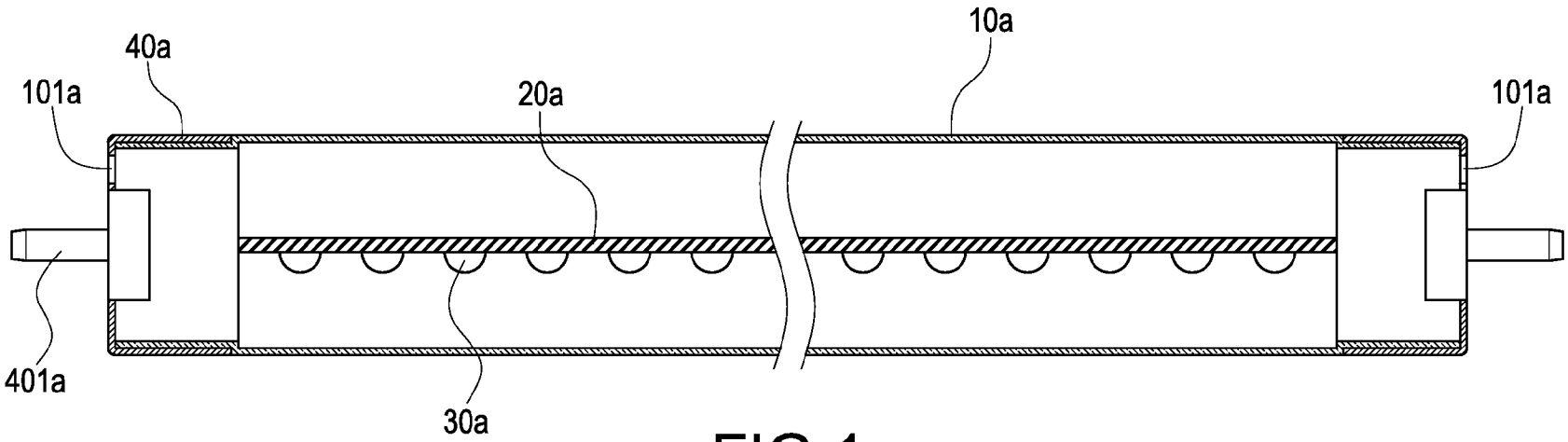
FIG.1 PRIOR ART
FIG. 1 is a schematic view of a conventional LED lamp tube.
Figure 2:
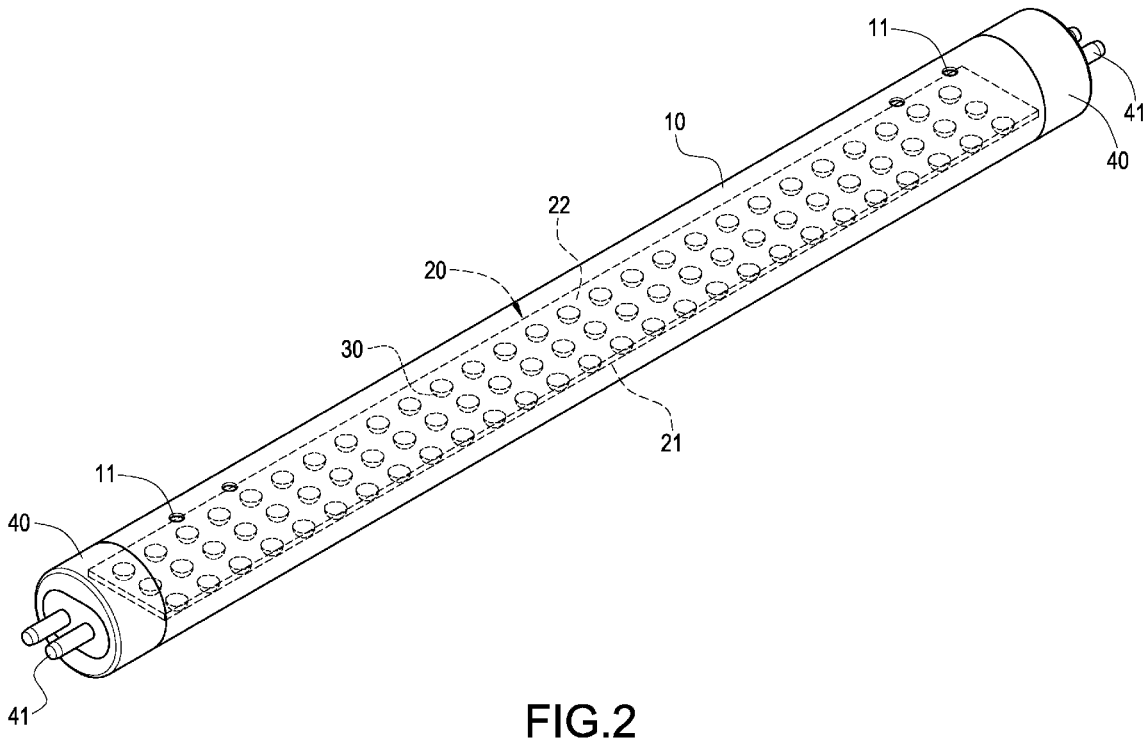
FIG. 2 is a perspective view of the present invention.
Figure 3:
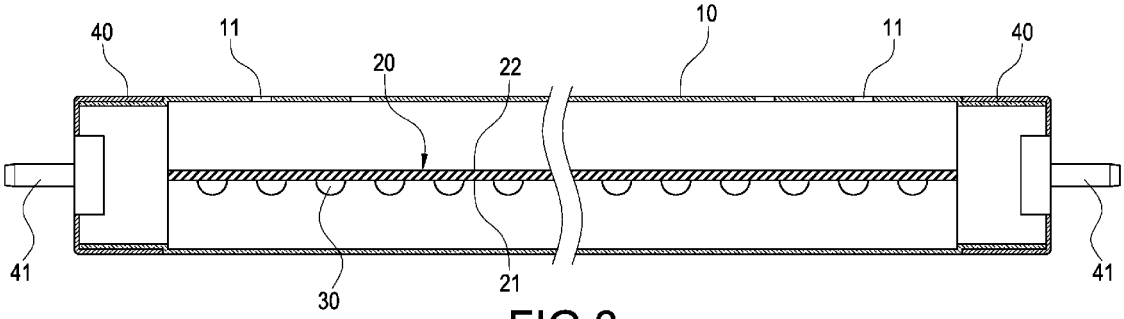
FIG. 3 is a cross-sectional view of the present invention.

With reference to FIGS. 2 and 3 for a perspective view and a cross-sectional view of the present invention respectively, an LED lamp tube heat dissipating structure of the invention comprises: a circuit board 20 disposed in a tube 10 made of a light transmitting plastic material; at least one heat dissipating hole 11 disposed separately on both distal surfaces of the tube 10*a*, wherein and two heat dissipating holes 11 are disposed on both distal surfaces of one of the left and right sides of the tube 10 in this preferred embodiment, and the quantity of heat dissipating holes 11 can be set according to actual needs; a circuit board 20 having a light radiating surface 21 and a heat dissipating surface 22; a plurality of LED lamps 30 electrically coupled to the circuit board 20 and arranged with an interval apart from each other and disposed on the light radiating surface 21 of the circuit board 20, wherein the heat dissipating surface 22 of the circuit board 20 faces towards the heat dissipating hole 11 of the tube 10 and is contained in the tube 10.

A conductive bushing 40 electrically coupled to the circuit board 20 is sheathed separately on both ends of the tube 10, and an electric conducting terminal 41 is protruded from a distal surface of the conductive bushing 40 and plugged into the lamp holder for supplying an electric power to the LED lamp tube.

Figure 4:
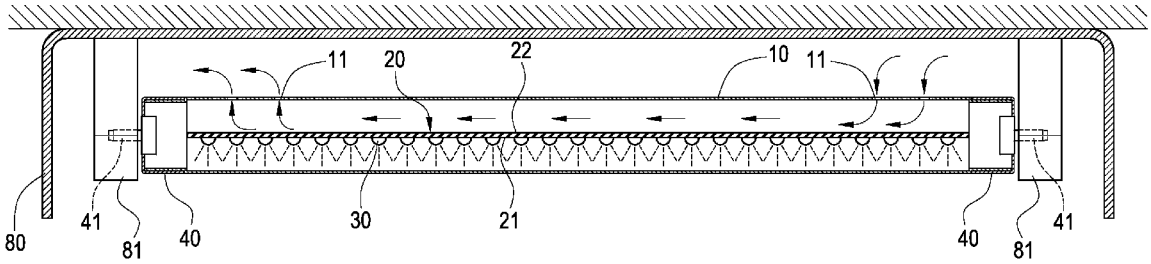
FIG. 4 is a schematic view of an application in accordance with the present invention.

With reference to FIG. 4 for a schematic view of an application of the present invention, the LED lamp tube is installed in a lamp holder 80 of a ceiling, and the lamp holder 80 includes a socket 81, and the electric conducting terminals 41 of the conductive bushings 40 on both ends of the tube 10 are plugged into the socket 81, such that a power source is conducted to drive the LED lamp 30 on the light radiating surface 21 of the circuit board 20 to emit light, and the heat produced by the LED lamp 30 after a certain time of use is dissipated from the heat dissipating surface 22 of the circuit board 20 and accumulated in the tube 10. Now, external air is entered into the tube 10 from the heat dissipating holes on a distal surface of the tube 10*a* and the heat in the tube 10 is absorbed and conducted along the internal wall of the tube 10, and the heated air is dissipated from the heat dissipating holes 11 on another distal surface of the tube 10 and the heat in the tube 10 is carried away. In addition, the quantity of heat dissipating holes 11 can be increased to accelerate the heat dissipation without affecting the natural convection.

Since the heat dissipating holes are disposed on both distal surfaces of the tube in the LED lamp tube heat dissipating structure of the present invention, air is passed into the heat dissipating hole from a distal surface of the tube and the heat in the tube is absorbed, and the heated air is dissipated to the outside directly from the heat dissipating holes on another distal surface of the tube. Compared with the conventional LED lamp tube, the present invention can discharge the hot air in the tube quickly to improve the heat dissipating efficiency effectively, so as to maintain the light emitting efficiency of the LED lamp, extend the life of the LED, and reduce maintenance and application costs.

While the invention is described in by way of examples and in terms of preferred embodiments, it is to be understood that the invention is not limited thereto. On the contrary, the aim is to cover all modifications, alternatives and equivalents falling within the spirit and scope of the invention as defined by the appended claims.

What is claimed is:

1. A light emitting diode (LED) lamp tube heat dissipating structure, comprising:

a tube;

a circuit board, contained in the tube, and having a light radiating surface and a heat dissipating surface;

a plurality of LED lamps, installed on the light radiating surface of the circuit board and electrically coupled with the circuit board;

two conductive bushings, sheathed onto both ends of the tube respectively, and electrically coupled with the circuit board; and at least one heat dissipating hole disposed separately on both distal surfaces of the tube that is covered onto the heat dissipating surface of the circuit board, such that the heat dissipating surface faces towards the heat dissipating hole.

2. The light emitting diode (LED) lamp tube heat dissipating structure of claim 1, wherein the tube is made of a light transmitting plastic material.

3. The light emitting diode (LED) lamp tube heat dissipating structure of claim 1, wherein the heat dissipating hole comes with a quantity greater than one.

4. The light emitting diode (LED) lamp tube heat dissipating structure of claim 1, wherein the LED lamps are disposed with an interval apart from each other and on the light radiating surface of the circuit board.

* * * * *